US006202519B1

(12) United States Patent
Yandt

(10) Patent No.: US 6,202,519 B1
(45) Date of Patent: Mar. 20, 2001

(54) BRAKE TESTING DEVICE

(76) Inventor: Barry Victor Yandt, RR#9 1290 Armour Road, Peterborough, Ontario (CA), K9J 6Y1

( * ) Notice: Subject to any disclaimer, the term of this patent is extended or adjusted under 35 U.S.C. 154(b) by 0 days.

(21) Appl. No.: 09/301,455

(22) Filed: Apr. 29, 1999

Related U.S. Application Data

(63) Continuation-in-part of application No. 09/087,507, filed on May 29, 1998, now abandoned.

(51) Int. Cl.[7] ..... B25B 33/00
(52) U.S. Cl. ..... 81/488; 81/177.2; 81/489
(58) Field of Search ..... 81/488, 177.2, 81/484

(56) References Cited

U.S. PATENT DOCUMENTS

| | | |
|---|---|---|
| 1,554,468 | 9/1925 | Tague . |
| 1,699,039 | 1/1929 | Abrahamson . |
| 1,907,835 | 5/1933 | Langbein . |
| 1,950,640 | 3/1934 | Twyman . |
| 3,190,090 | 6/1965 | Zaidener . |
| 4,432,432 | 2/1984 | Martin . |
| 4,825,671 | 5/1989 | Wen . |
| 4,856,388 | 8/1989 | Freeman . |
| 4,960,015 | 10/1990 | Mathews . |
| 5,345,796 | 9/1994 | Chieh et al. . |
| 5,481,950 | 1/1996 | Browning . |

OTHER PUBLICATIONS

Brake Mate Advert—Peterborough Commercial Services, No Date.

*Primary Examiner*—James G. Smith
(74) *Attorney, Agent, or Firm*—James E. Gastle

(57) ABSTRACT

A brake testing device for a transport vehicle having a brake pedal and a steering wheel, the steering wheel having a rim portion, the device having a shaft member whose length is selected to extend between the brake pedal and the steering wheel; first engagement means mounted on the shaft for engaging the rim portion; second engagement means for engaging the brake pedal, wherein the device is operable to maintain the brake pedal at an operative position.

4 Claims, 3 Drawing Sheets

BRAKE TESTING DEVICE

REFERENCE TO CO-PENDING APPLICATION

This is a Continuation-in-Part of application Ser. No. 09/087,507 filed May 29, 1998, now abandoned, in the name of Barry Victor Yandt, entitled BRAKE TOOL, IN PARTICULAR BRAKE APPLIER, the subject matter of which is incorporated herein by reference.

BACKGROUND OF THE INVENTION

1. Field of the Invention

The present invention relates to transportation vehicles and more particularly to methods of testing brakes therein.

2. Description of the Related Art

An important part of operating a transportation vehicle such as a truck, is the regular checking of the pneumatic or hydraulic brakes. Under Ontario Regulation 575 of the Ontario Highway Traffic Act, the operator of a commercial Motor Vehicle shall inspect the Commercial Motor Vehicle before the vehicle's first trip of the day. Under Schedule 1, item II, the vehicle operator must inspect the brake adjustment and brake system for leaks. On Nov. 1, 1996, under the Trade Qualification and Apprentice Act, a regulation was passed that vehicle operators must be certified to adjust the brakes on the vehicle they are operating. For a vehicle operator to check his brake adjustment on an pneumatic brake system, he must have the air pressure between 90 and 100 psi with the engine off and make a full brake application. The vehicle operator then must either measure the brake push rod travel or look at his preset brake indicators on each wheel and the brakes must be applied while doing this.

The only effective way for a vehicle operator to test the brake system is to keep the brake pedal in an operative position, that is one which pressurizes an hydraulic brake system to check for oil leaks, for example. In a pneumatic system, the brake pedal, in its operative position, releases the pressure in the brake system, which means that the brake cylinders should be in their fully engaged position, which again is best seen, at least for a periodic check, by walking around the vehicle and looking at the exterior features of the brake assemblies at each wheel.

However, without another person to engage the brake for the vehicle operator, there is no effective means by which the vehicle operator can check the brakes while having the brake pedal in its operative position.

Not surprisingly, under the North American Commercial Vehicle Safety Alliance, the largest percentage of problems with Commercial Vehicles reported during road checks is the correct adjustment of the brakes. It would be desirable, therefore, that the vehicle operator be provided with an effective tool to maintain the brake pedal in an operative position, in a manner that allows the vehicle operator to leave the cab of the vehicle to check the brakes.

It is an object of the present invention to provide an improved technique for testing the brakes of a vehicle.

SUMMARY OF THE INVENTION

Briefly stated, the invention involves a brake testing device for a transport vehicle, the vehicle having a brake pedal and a steering wheel, the steering wheel having a rim portion, the device comprising a shaft member whose length is selected to extend between the brake pedal and the steering wheel; first engagement means mounted on the shaft for engaging the rim portion; second engagement means for engaging the brake pedal, wherein the device is operable to maintain the brake pedal at an operative position.

In another of its aspects, the present invention provides a method of testing the brakes of a transport vehicle, the vehicle having a brake pedal and a steering wheel with a rim portion, comprising the steps of:

- positioning a length-extensible shaft member between the brake pedal and the rim portion,
- depressing the brake pedal to an operative braking position;
- adjusting the length of the shaft member until one end is positioned adjacent the brake pedal and the other end is positioned adjacent the rim portion;
- engaging respective end regions of the shaft member respectively with the pedal and the rim portion; and
- locking the length of the shaft member, in order that the brake remains in the operative braking position.

BRIEF DESCRIPTION OF THE DRAWINGS

Several preferred embodiments of the present invention will now be described, by way of example only, with reference to the appended drawing in which.

DESCRIPTION OF THE PREFERRED EMBODIMENTS

Figure 1:
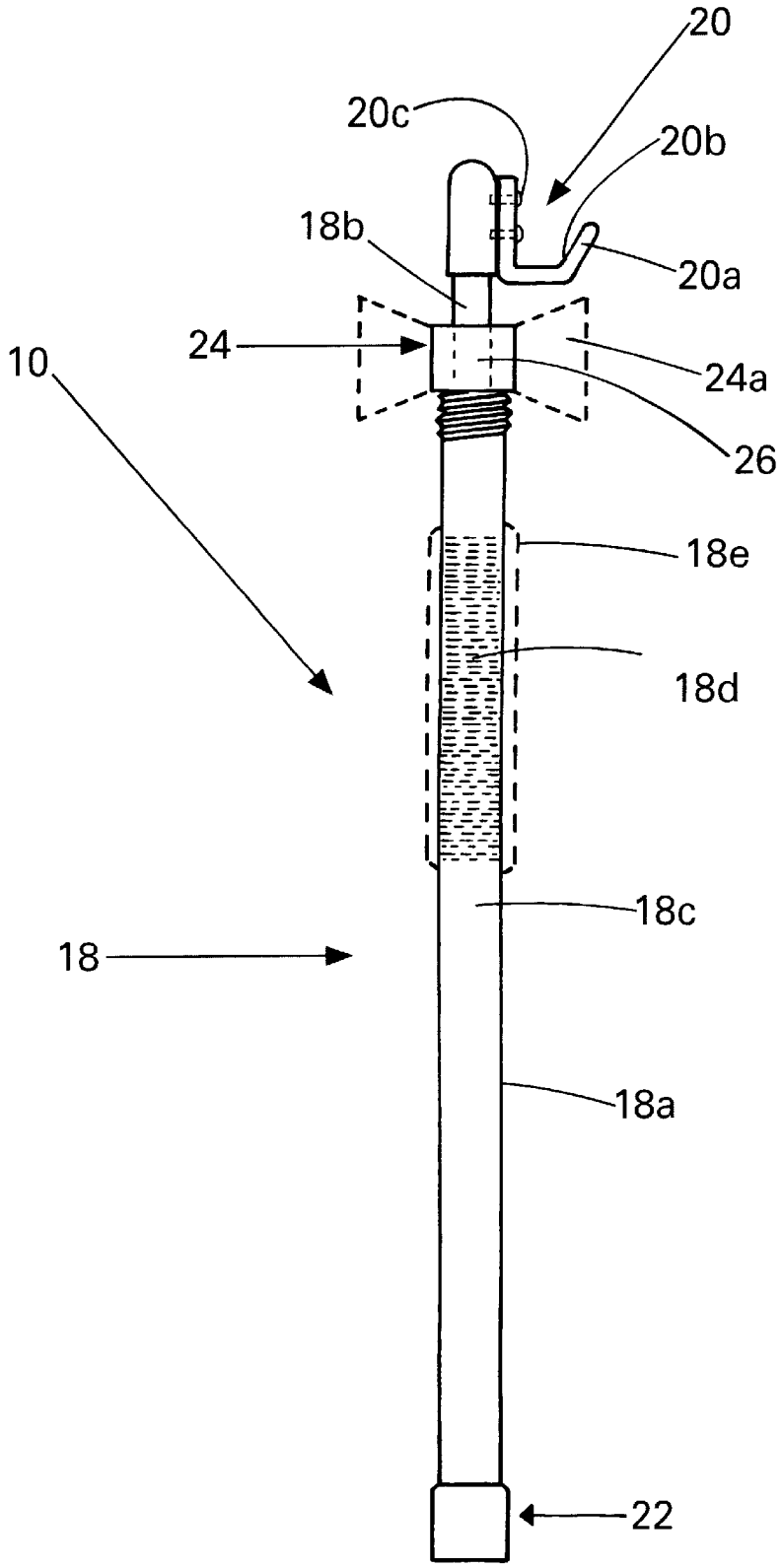
FIG. 1 is a side view of a device for testing brakes of a vehicle.
Figure 2A:
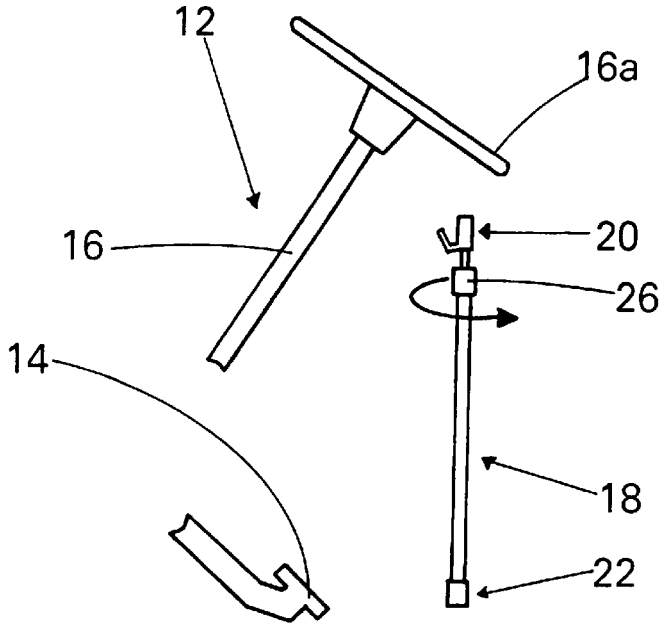
FIGS. 2*a*, 2*b* and 2*c* are schematic operational views of the device of FIG. 1.
Figure 2B:
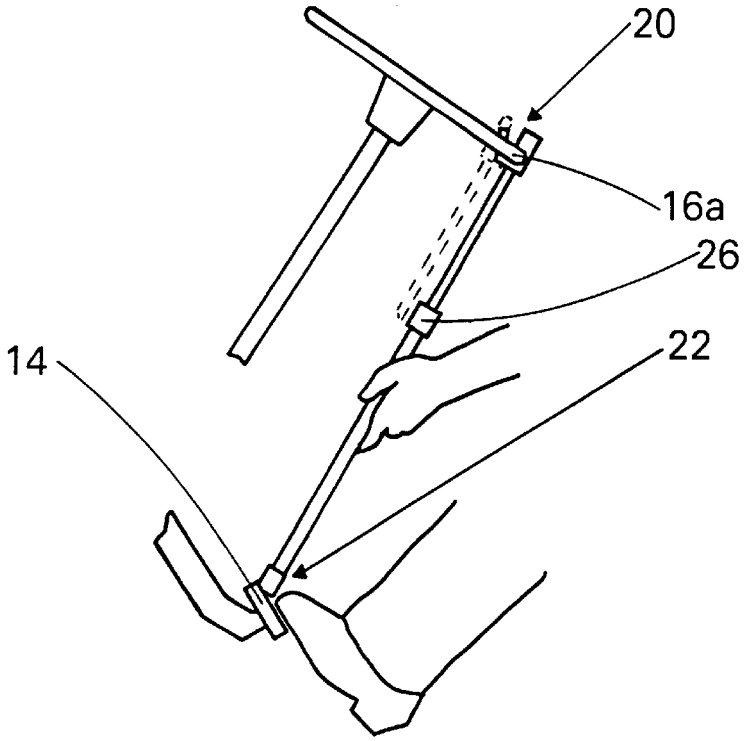
Figure 2C:
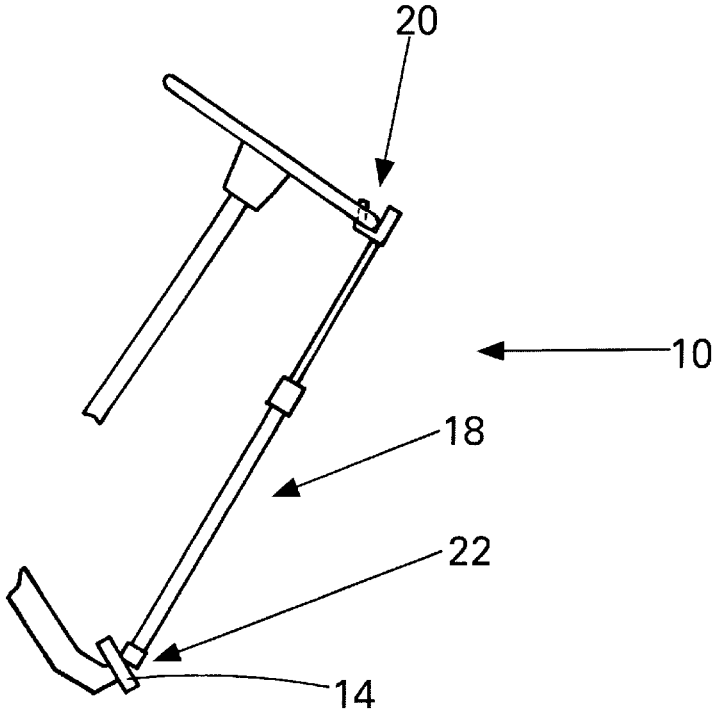

FIG. 1 shows a brake testing device 10 for a transport vehicle. As will be described, the device 10 is for use with a vehicle, a portion of which is shown at 12 in FIG. 2*a* having a brake pedal 14 and a steering wheel 16, the steering wheel having a rim portion 16*a*. As can be generally seen in FIGS. 2*a* to 2*c* and as will be described in more detail below, the device 10 is useful to maintain the brake pedal 14 in an operative position allowing the vehicle operator to leave the truck vehicle and inspect the brake system thereon.

Referring once again to FIG. 1, the device 10 has a shaft member 18 whose length is selected to extend between the brake pedal 14 and the steering wheel 16. Mounted on the shaft member 18 is a first engagement means, shown generally at 20, for engaging the rim portion 16*a* and a second engagement means, shown generally at 22, for engaging the rim portion brake pedal 14.

Desirably, the shaft member 18 is provided with an outer shaft portion 18*a* telescopingly engaged with an inner shaft portion 18*b*. The shaft member 18 also has a fixing means, shown generally at 24, for fixing the shaft member at a predetermined length sufficient to maintain the brake pedal at its operative position, that is by fixing the position of the outer shaft portion 18*a* relative to the inner shaft portion 18*b*. In one embodiment, the fixing means includes a manually adjustable portion, which is rotationally mounted on the shaft, such as a threaded nut 26. In this case, the threaded nut is threadably engaged with the outer shaft portion 18*a*. In addition, the outer shaft portion has an outer surface 18*c* which is knurled, as shown at 18*d*, or otherwise finished to provided a roughened hand-grip surface to assist in locking the position of the outer and inner shaft portions. If desired, the outer surface 18*c* may alternatively be provided with an exterior layer, shown in dashed lines in 18*e*, which may be in the form of a hand-grip or a sand paper layer or some other form enhancing the grip for the vehicle operator to tighten the connection. In addition, the lock nut 24 may, if desired, be provided with an enlarged hand gripping portion as shown in dashed lines at 24*a*. Alternatively, other mechanical means may be employed to fix the position of the inner shaft portion relative to the outer shaft portion, such as by the use of push pines, locking cams, levers and the like.

Figure 3:
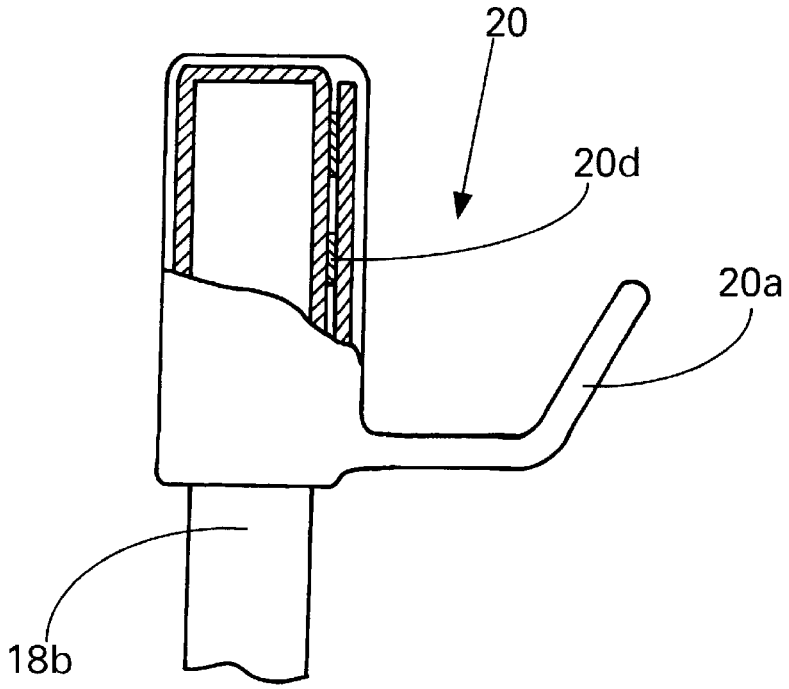
FIG. 3 is a fragmentary partly-sectioned side view of a section of another device for testing vehicle brakes.

The first engaging member 20 is mounted on the inner shaft portion 18*b* and, in this case, includes a flange 20*a* extending laterally outwardly from the first portion. The flange has an inside face 20*b* arranged to receive the rim portion 16*a*. In this case, the flange has a resilient outer layer. The flange may be fastened on the inner shaft portion in a number of ways, including by the use of screw fasteners 20*c* as shown in FIG. 1 or by one or more appropriately positioned welds (such as that formed by spot-or arc-welding or the like) as shown at 20*d* in FIG. 3. The first engaging means may have other forms, such as other shaped flanges and the like which provide a surface capable of engaging the rim of the steering wheel.

The second engaging member is mounted on the outer shaft portion 18*a* and, in this case, is in the form of a cap member formed from a resilient coating and positioned thereon, though other arrangements are also contemplated such as the use of flanges and the like which are capable of engaging the brake pedal.

To use the device, the vehicle operator loosens the nut 24 and pulls the inner shaft portion outwardly relative to the outer shaft portion to provide a shaft length that closer approximates the distance between the rim portion 16*a* and the brake pedal 14. The vehicle operator may then choose to sightly tighten the nut to allow for some, but nonetheless tighter, movement between the portions. The vehicle operator then brings the flange 20*a* into engagement with the rim portion 16*a*, either with the shaft on the outside of the rim as shown in solid lines in FIG. 2*b* or with the shaft on the inside as shown in dashed lines in FIG. 2*b*.

Next, the operator depresses the brake pedal to an operative position, which may be when the brake pedal is fully or partially depressed, but nonetheless is a position wherein the brakes are operative, at least to partially engage the brake shoes or pads, for example, against their associated wheel drum or disc as the case may be. The operator then makes another adjustment, if necessary, to adjust the length of the shaft member to accommodate this spacing between the brake pedal and the rim 16*a*. The operator may then twist the nut to inhibit the relative movement of the two shaft portions. Alternatively, the operator may twist the outer shaft portion with one hand and simply grip the nut with the other hand to lock the shaft portions in portion.

With the device 10 in its operative position, the vehicle operator can leave the cab of the vehicle and walk around the vehicle to check to see that the brakes are properly adjusted, that the brake lights are working properly as well as to check for air or hydraulic fluid leaks. The device may also be used for a number of other jobs, such as to apply the clutch pedal or the throttle pedal for clutching or throttling adjustments.

Thus, the invention provides a method of testing the brakes of a transport vehicle, the vehicle having a brake pedal and a steering wheel with a rim portion, comprising the steps of positioning a length-extensible shaft member between the brake pedal and the rim portion, depressing the brake pedal to an operative braking position;

adjusting the length of the shaft member until one end is positioned adjacent the brake pedal and the other end is positioned adjacent the rim portion;

engaging respective end regions of the shaft member respectively with the pedal and the rim portion; and locking the length of the shaft member, in order that the brake remains in the operative braking position.

Thus, the present invention provides a device for testing brake systems in brake systems of vehicles, such as commercial vehicles as well as passenger and other vehicles.

What is claimed is:

1. A method of testing the brakes of a transport truck vehicle, said transport truck vehicle having a brake pedal and a steering wheel with a rim portion, comprising the steps of:

a) providing a length adjustable shaft member having an outer shaft portion and an inner shaft portion telescopingly engaged for sliding movement therewith and a nut threaded on the outer shaft portion which is rotatable to fix the position of the outer shaft portion relative to the inner shaft portion, b) loosening the nut and sliding the outer shaft portion relative to the inner shaft portion so that the length of the length adjustable shaft member approximates the distance between the rim portion and the brake pedal and then partially tightening the nut;

c) after step b), positioning the length adjustable shaft member between the brake pedal and the rim portion, d) depressing said brake pedal to an operative braking position;

e) adjusting the length of said shaft member while engaging respective end regions of the shaft member respectively with said pedal and said rim portion; and f) twisting the nut relative to the outer shaft portion to fix the length of said shaft member, in order that said brake remains in said operative braking position.

2. A method as defined in claim 1 wherein the inner shaft member includes a laterally outwardly extending flange, the method including, after step e) and before step f), the step of engaging the flange with the rim portion.

3. A method as defined in claim 2, wherein step f) includes gripping the outer shaft portion with one hand and gripping the nut with the other hand.

4. A method as defined in claim 1 wherein step d) includes either partially or fully depressing the brake.

* * * * *